US009972223B2

(12) United States Patent
Larsen

(10) Patent No.: US 9,972,223 B2
(45) Date of Patent: May 15, 2018

(54) BANDS USED FOR INDICATING A TYPE OF TUBING

(71) Applicant: James Carl Larsen, Voorhees, NJ (US)

(72) Inventor: James Carl Larsen, Voorhees, NJ (US)

( * ) Notice: Subject to any disclaimer, the term of this patent is extended or adjusted under 35 U.S.C. 154(b) by 503 days.

(21) Appl. No.: 14/606,693

(22) Filed: Jan. 27, 2015

(65) Prior Publication Data

US 2015/0213736 A1 Jul. 30, 2015

Related U.S. Application Data

(60) Provisional application No. 61/932,095, filed on Jan. 27, 2014.

(51) Int. Cl.

| | |
|---|---|
| ***G09F 3/00*** | (2006.01) |
| ***G09F 3/04*** | (2006.01) |
| ***G09F 3/06*** | (2006.01) |
| *G09F 3/02* | (2006.01) |

(52) U.S. Cl.

CPC ..... *G09F 3/0295* (2013.01); *G09F 3/06* (2013.01); *G09F 2003/0251* (2013.01); *Y10T 29/49826* (2015.01); *Y10T 29/49876* (2015.01)

(58) Field of Classification Search

CPC .. G09F 3/0295; G09F 3/06; G09F 2003/0251; Y10T 29/49876; Y10T 29/49826

See application file for complete search history.

(56) References Cited

U.S. PATENT DOCUMENTS

| | | | | |
|---|---|---|---|---|
| 5,115,586 | A * | 5/1992 | Hawker | G02B 6/4482 40/316 |
| 5,402,592 | A | 4/1995 | Caveney et al. | |
| 6,481,054 | B1 * | 11/2002 | Hillstrom | A63B 71/0672 16/252 |
| 7,946,244 | B2 | 5/2011 | Dowler et al. | |
| 8,516,727 | B1 | 8/2013 | Maraia | |

* cited by examiner

*Primary Examiner* — John C Hong

(74) *Attorney, Agent, or Firm* — Dunlap Bennett & Ludwig PLLC

(57) ABSTRACT

A method of labeling telecommunication cable is provided. At least one band including an indicator is provided. The bands are placed around and attach to the cable. The amount of bands or the color of the bands secured to the cable may indicate the type of cable.

10 Claims, 7 Drawing Sheets

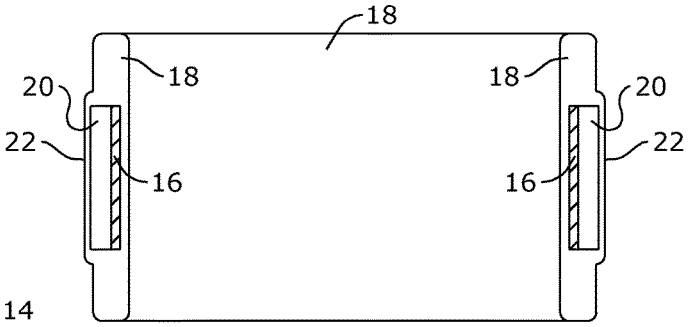
FIG.5
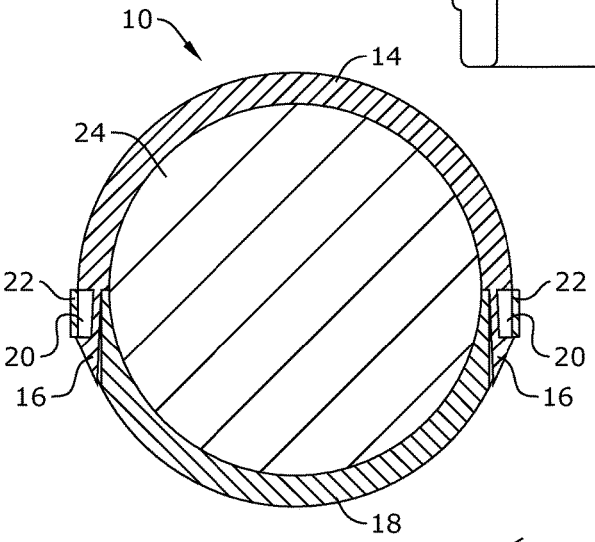
FIG.6
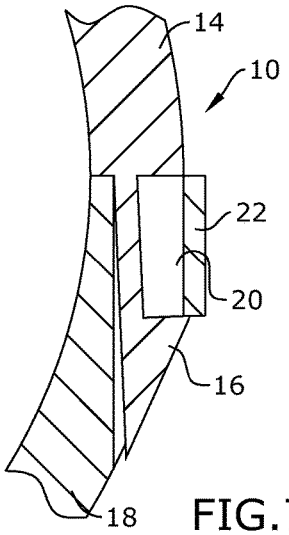
FIG.7
FIG.8
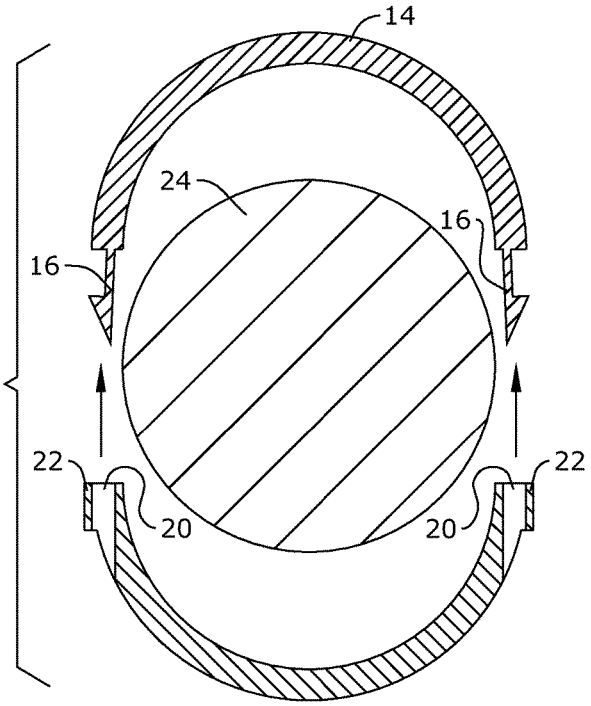

BANDS USED FOR INDICATING A TYPE OF TUBING

CROSS-REFERENCE TO RELATED APPLICATION

This application claims the benefit of priority of U.S. provisional application Ser. No. 61/932,095, filed Jan. 27, 2014, the contents of which are herein incorporated by reference.

BACKGROUND OF THE INVENTION

The present invention relates to telecommunication cable and, more particularly, to bands that are used for indicating the type of telecommunication cable.

A cellular network or mobile network is a wireless network distributed over land areas called cells, each served by at least one fixed-location transceiver, known as a cell tower or base station. In a cellular network, each cell uses a different set of frequencies from neighboring cells, to avoid interference and provide guaranteed bandwidth within each cell. When joined together these cells provide radio coverage over a wide geographic area. This enables a large number of portable transceivers (e.g. mobile phones, pagers, etc.) to communicate with each other and with fixed transceivers and telephones anywhere in the network, via base stations, even if some of the transceivers are moving through more than one cell during transmission. Currently, electrical cables are used within the cell towers. Each electrical cable may include a different sector type, wireless technology type, and branch type. Colored tape is secured to each cable to identify the cable type. However, the color of the tape fades, the tape falls off, and ultimately the tape needs to be replaced frequently.

As can be seen, there is a need for an improved method of indentifying the cables of a cellular tower.

SUMMARY OF THE INVENTION

In one aspect of the present invention, a method of labeling telecommunication cable comprises: providing a plurality of bands each comprising: an inner surface and an outer surface; a first link having a first end and a second end; a second link having a first end and a second end, wherein the first end of the first link is attached to the first end of the second link, wherein the second end of the first link comprises a female connector and the second end of the second link comprises a male connector; placing at least one of the plurality of bands around a cable; and connecting the male connector to the female connector, thereby securing the band to the cable, wherein the band secured to the cable indicates a type of cable.

These and other features, aspects and advantages of the present invention will become better understood with reference to the following drawings, description and claims.

BRIEF DESCRIPTION OF THE DRAWINGS

FIG. 5 is a section view of the present invention, taken along line 5-5 in FIG. 2;

FIG. 6 is a section view of the present invention, taken along line 6-6 in FIG. 1;

FIG. 7 is a detail section view of an embodiment of the present invention;

FIG. 8 is a section view of an embodiment of the present invention showing a removal of a clip from a female portion;

DETAILED DESCRIPTION OF THE INVENTION

Figure 1:
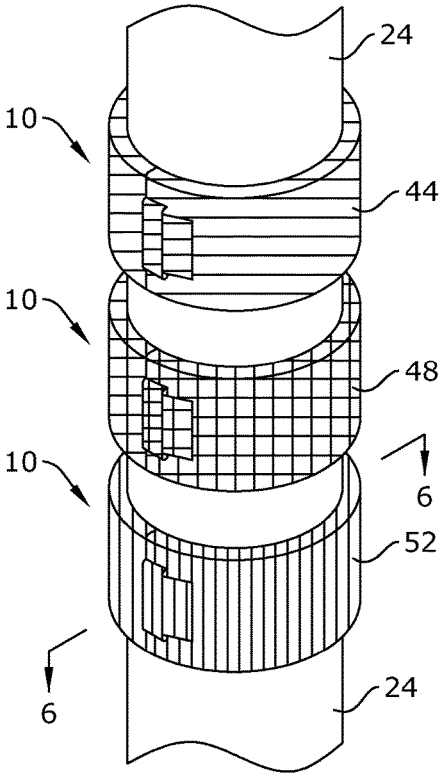
FIG. 1 is a perspective view of an embodiment of the present invention shown in use.
Figure 2:
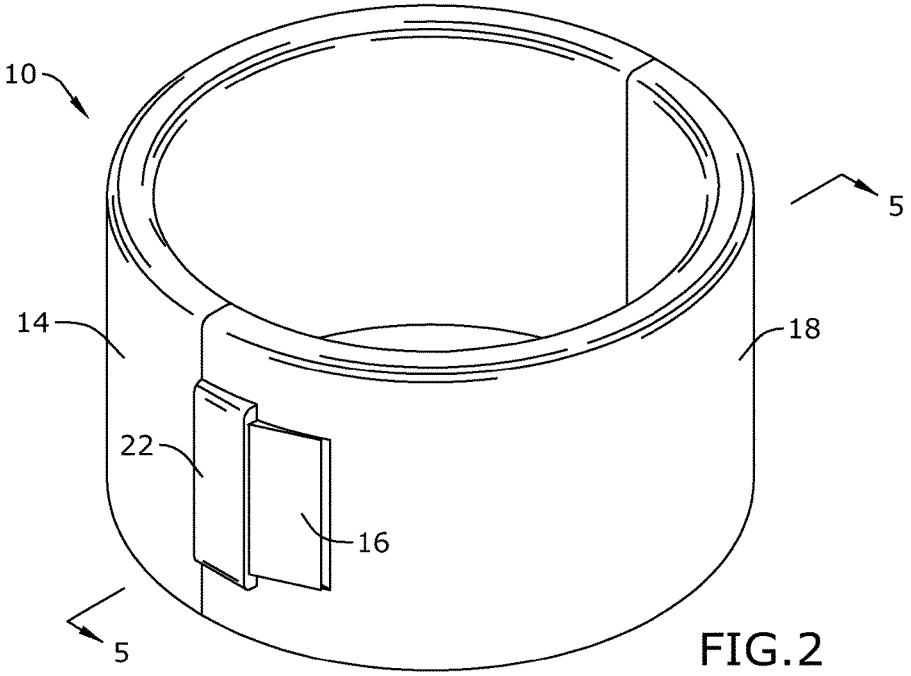
FIG. 2 is a perspective view of an embodiment of the present invention.
Figure 3:
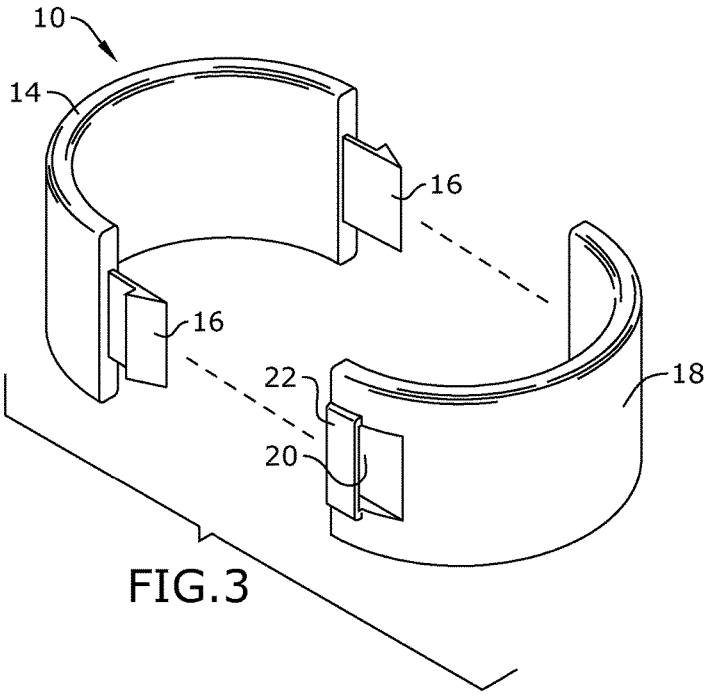
FIG. 3 is a front exploded view of an embodiment of the present invention.
Figure 4:
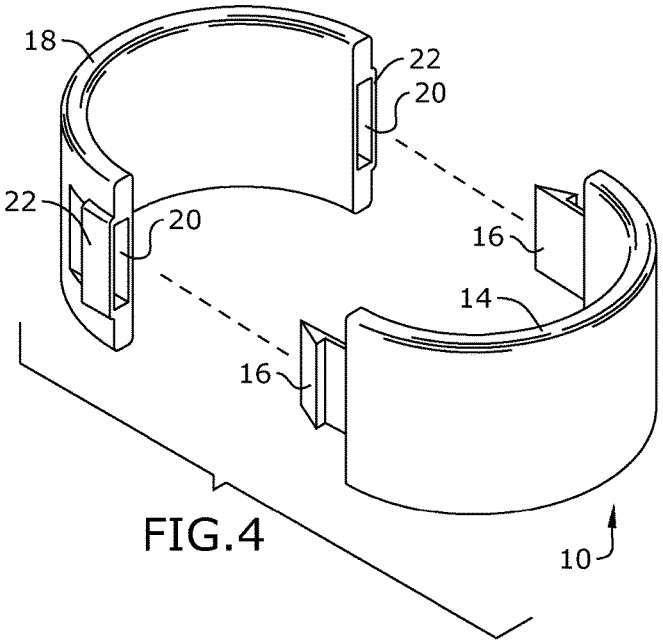
FIG. 4 is a rear exploded view of an embodiment of the present invention.
Figure 9:
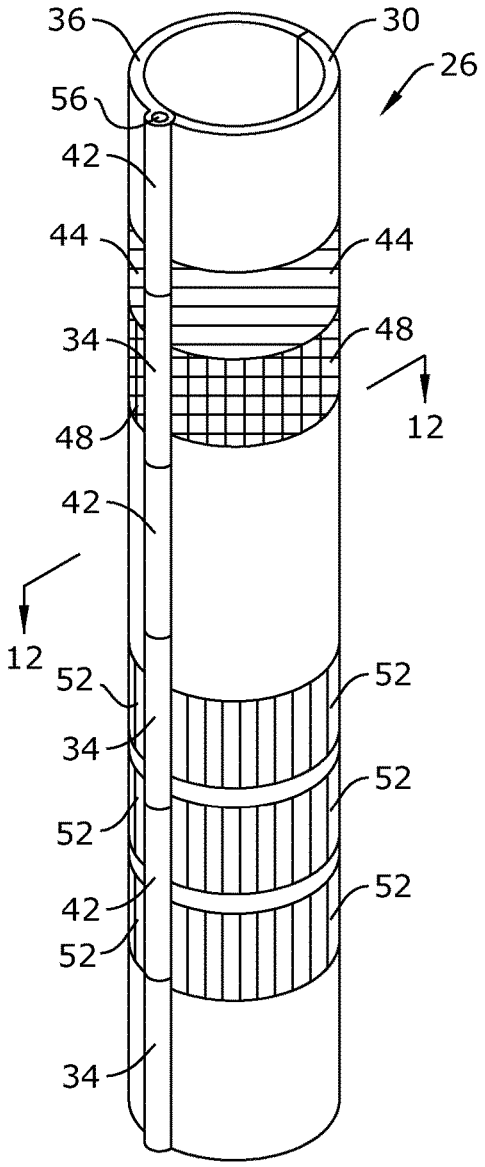
FIG. 9 is a front perspective view of an embodiment of the present invention.
Figure 10:
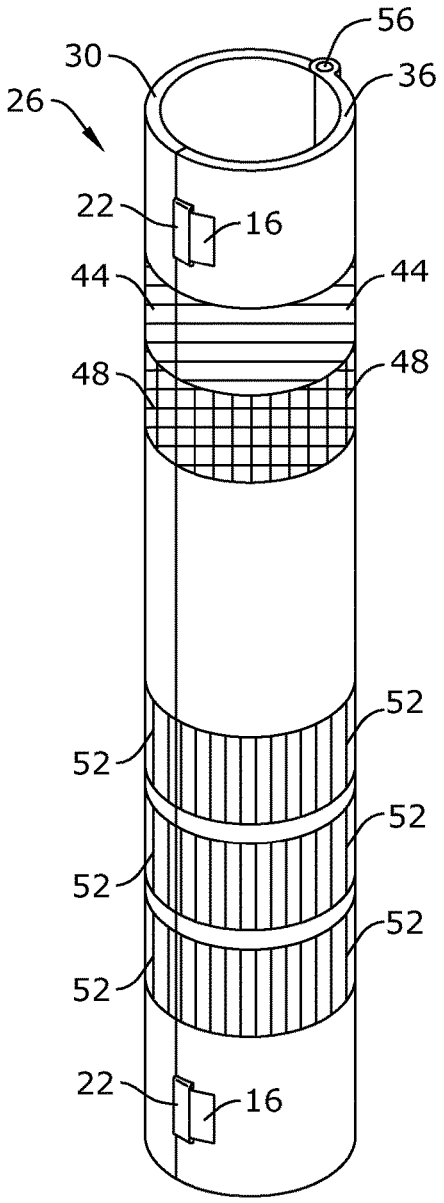
FIG. 10 is a rear perspective view of an embodiment of the present invention.
Figure 11:
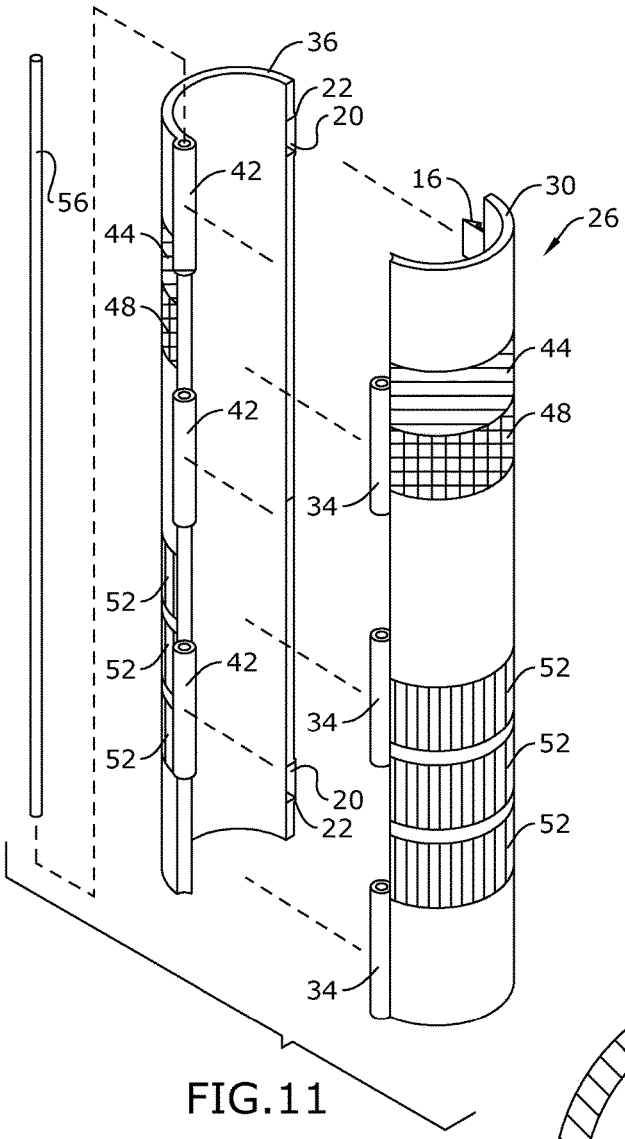
FIG. 11 is an exploded view of an embodiment of the present invention.
Figure 12:
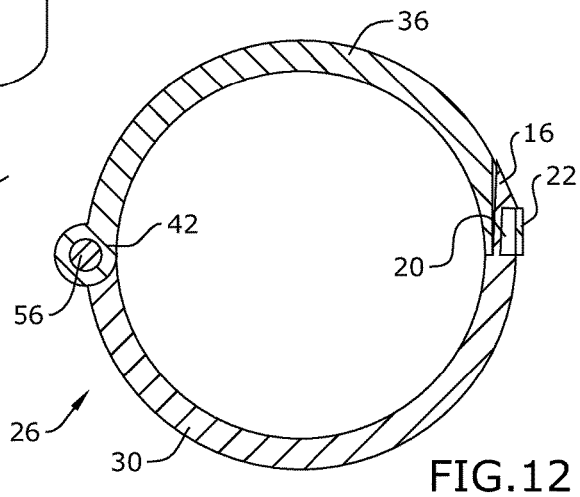
FIG. 12 is a section view of the present invention, taken along line 12-12 in FIG. 9.
Figure 13:
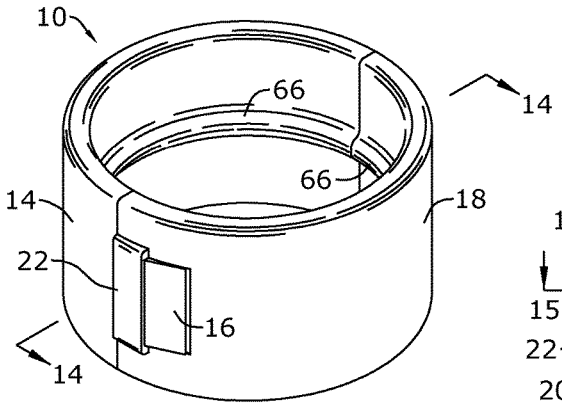
FIG. 13 is a perspective view of an embodiment of the present invention.
Figure 14:
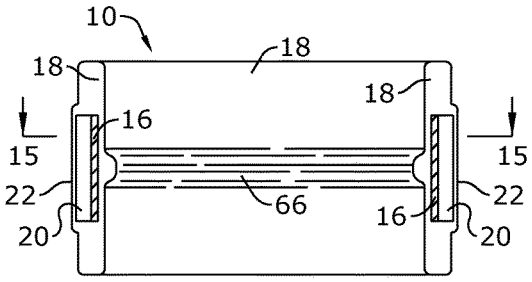
FIG. 14 is a section view of the present invention, taken along line 14-14 in FIG. 13.
Figure 15:
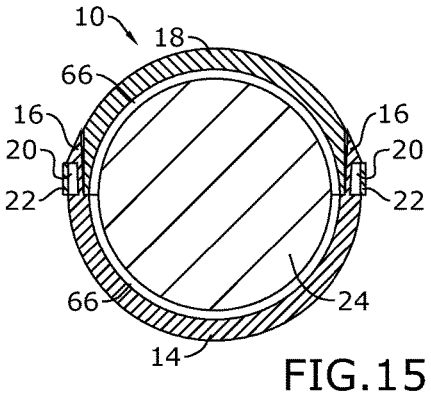
FIG. 15 is a section view of the present invention, taken along line 15-15 in FIG. 14.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a plurality of bands that are used to identify a sector type, a wireless technology type, and a branch type when clamped to various sized cable. Cable of the present invention is defined as an electrical wiring or a conduit that contains a plurality of electrical wiring. The present invention may be used for the telecommunications business, such as the cellular networks, to help identify cable for future maintenance. The colors of the rigid bands fade at a much slower rate as compared to the tape. Therefore, the bands of the present invention save a lot of time required to replace the tape currently used. Further, the bands of the present invention are easy and quick to snap onto the cable and are re-usable.

Referring to FIGS. 1 through 19, the present invention includes a plurality of bands 10. The bands 10 include an inner surface and an outer surface. Each of the bands may be formed of two pieces, a first link 14 and a second link 18. The first link 14 and the second link 18 each include a first end and a second end. The first end of the first link 14 is attached to the first end of the second link 18. The second end of the first link 14 includes a female connector 20 and the second end of the second link 18 includes a male connector 16. To label telecommunication cable 24, the bands 10 may placed over the cable 24 and the male connector 18 connects to the female connector 20, thereby securing the bands 10 to the cable 24. The bands 10 indicate a type of cable 24 that they are secured to.

As mentioned above, the cable 24 may include electrical wiring, such as an electrical wiring in a tower or grounded electrical wiring, and a conduit that houses a plurality of electrical wiring. The type of cable 24 may include, but is not limited to, a sector type, a wireless technology type, and a branch type. A sector type may include an alpha, beta or gamma sector type. The wireless technology type may include Global System for Mobile Communications (GSM), Universal Mobile Telecommunications System (UMTS), Advanced Wireless Services (AWS), Long-Term Evolution (LTE), Personal Call System (PCS) and the like. The branch type may identify which cable belongs to what port.

In certain embodiments, the outer surface of each of the plurality of bands 10 may include an indicator 44, 48, 52 indicating the type of cable 24. The indicator 44, 48, 52 may be a pattern or color. For example a first color 44 may indicate the cable 24 is a gamma sector, and a second color 48 may indicate the cable 24 includes LTE technology. In certain embodiments, the amount of bands attached to the cable 24 may indicate the type of cable 24. As illustrated in FIG. 1, the cable 24 may include a plurality of bands with the same color 52, where three of the same color 52 indicates a first port, and two of the same color 52 indicates a second port. In certain embodiments, the present invention may be used as a combination of colors and amount of bands to determine each cable's characteristics.

Figure 18:
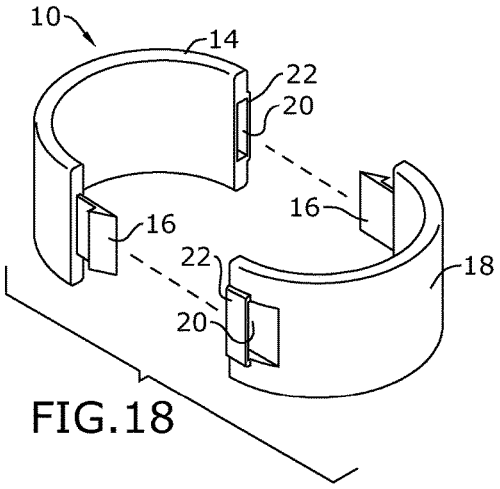
FIG. 18 is an exploded view of an embodiment of the present invention.
Figure 19:
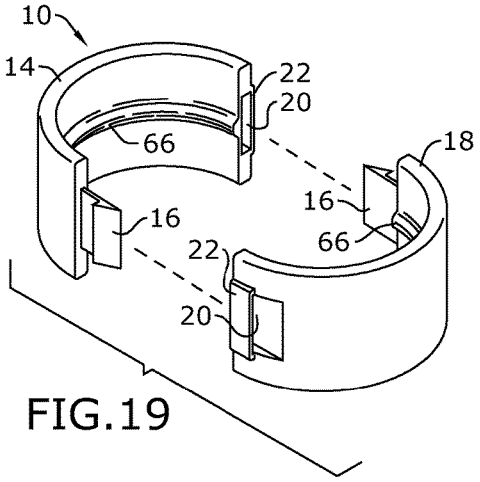
FIG. 19 is an exploded view of an embodiment of the present invention.
Figure 16:
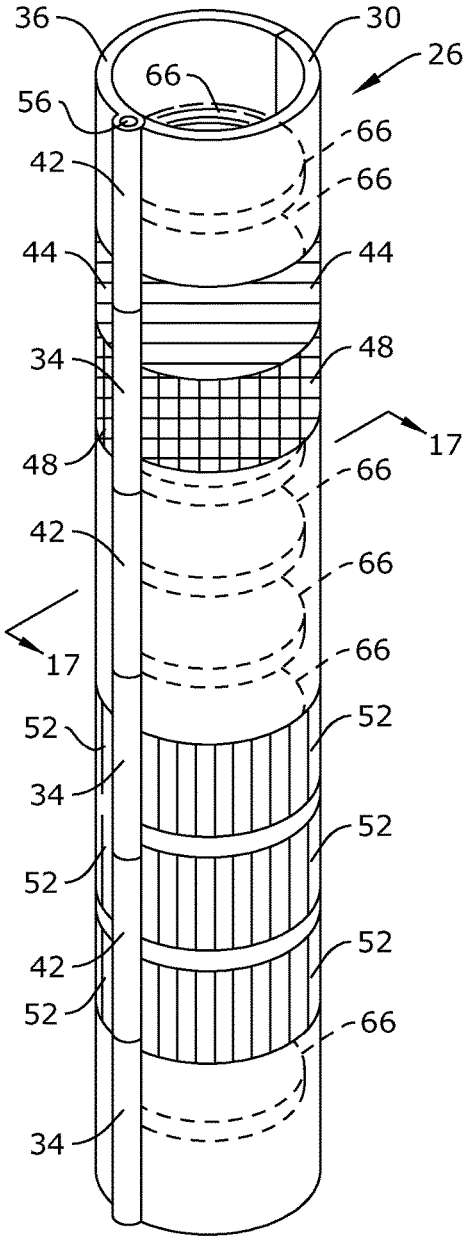
FIG. 16 is a perspective view of an embodiment of the present invention.
Figure 17:
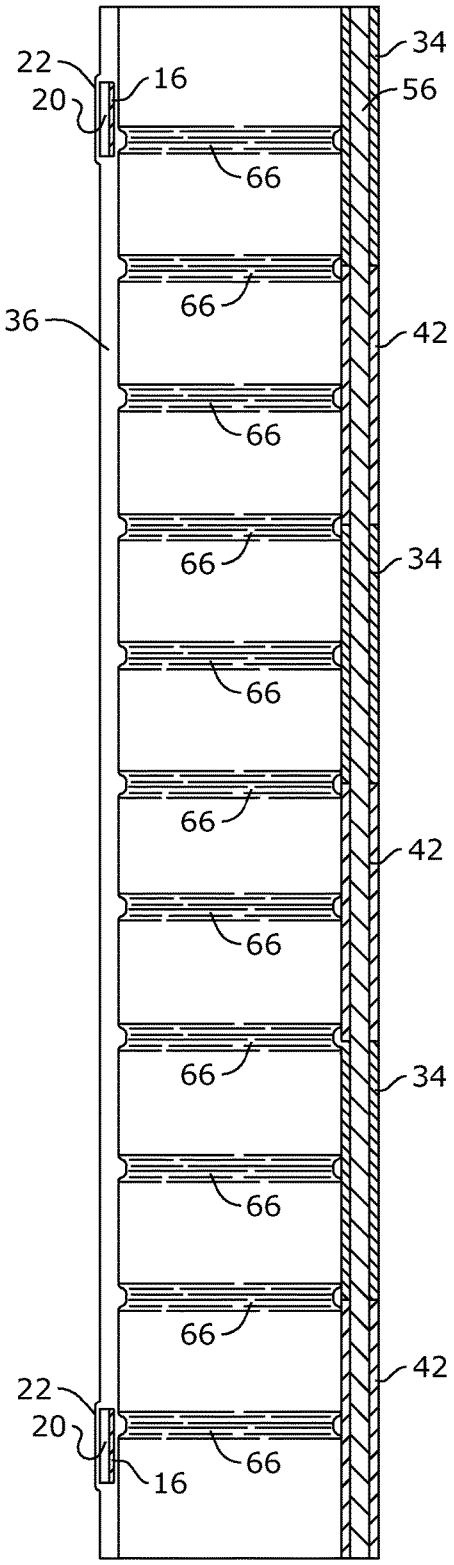
FIG. 17 is a section view of the present invention, taken along line 17-17 in FIG. 16.

As illustrated in the Figures, the male connectors 16 may include a snap and the female connectors 20 may include a socket and a retainer bar 22. The snap fits within the socket and locks onto the retainer bar 22. In certain embodiments, the first end of the first link 14 includes a male connector 16 and the first end of the second link 18 includes a female connector 20. Therefore, the first link 14 and the second link 18 may be separate components. As illustrated in FIGS. 18 and 19, the male connectors 16 and female connectors 20 may be interchanged on each of the ends of the first link 14 and second link 18.

In certain embodiments, the first end of the first link 14 and the first end of the second link 18 are attached by a hinge 34, 42, 56. Therefore, the band 10 may be joined as one piece. In such embodiments, the first link 14 may include first knuckles 34 interlocking with second knuckles 42 of the second link 18. A hinge pin 56 may fit through the knuckles pivotally connecting the first link 14 to the second link 18.

As illustrated in FIGS. 9-11, 16 and 17, the present invention may include an elongated band 26 having a first link 30 and a second link 36. In such embodiments, the outer surface of each of the elongated bands 26 may include multiple indicators 44, 48, 52, each of the indicators 44, 48, 52 indicating a sector type, a wireless technology type, and a branch type of the cable 24. In such embodiments, the type of cable 24 may be predetermined. The elongated band 26 may then be formed with indicators 44, 48, 52 printed out on the outer surface. An single band 26 may be created to have a first color 44 indicating the cable 24 is a gamma sector, a second color 48 indicating the cable 24 includes LTE technology, and a plurality of indicators 44, 48, 52 with the same color 52 indicating a first port. The single elongated band 26 may be attached to the cable 24.

A method of labeling telecommunication cable may include the following. The bands 10, 26 described above are provided. At least one of the plurality of bands 10, 26 is placed around a cable 24. The male connector 16 is attached to the female connector 20, thereby securing the band 10, 26 to the cable 24. An inner ridge 66 may be formed about the circumference of the inner surface of each of the bands 10, 26 to make sure that the band 10, 26 stays in place on the cable 24. The band 10, 26 secured to the cable 24 indicates a type of cable 24.

It should be understood, of course, that the foregoing relates to exemplary embodiments of the invention and that modifications may be made without departing from the spirit and scope of the invention as set forth in the following claims.

What is claimed is:

1. A method of labeling telecommunication cables comprising:

providing at least one elongated band comprising:

an inner surface and an outer surface;

a plurality of ring shaped indicators printed on the outer surface, wherein each of the plurality of ring shaped indicators indicate a different characteristic of a cable;

a first link having a first end and a second end; and a second link having a first end and a second end, wherein the first end of the first link is attached to the first end of the second link, wherein the second end of the first link comprises a female connector and the second end of the second link comprises a male connector;

placing the at least one elongated band around the cable; and connecting the male connector to the female connector, thereby securing the band to the cable.

2. The method of claim 1, wherein the indicator is at least one of a color and a pattern.

3. The method of claim 1, wherein the type of cable comprises at least one of a sector type, a wireless technology type, and a branch type.

4. The method of claim 1, wherein the cable is at least one of an electrical wiring and a conduit containing a plurality of electrical wiring.

5. The method of claim 1, wherein the first end of the first link is attached to the first end of the second link by a hinge.

6. The method of claim 1, wherein the first end of the first link comprises a male connector and the first end of the second link comprises a female connector, wherein the male connector attaches to the female connector.

7. The method of claim 1, wherein the male connector is a snap and the female connector is a socket and a retainer bar, wherein the snap fits within the socket and locks onto the retainer bar.

8. The method of claim 1, wherein an inner ridge is formed about the circumference of the inner surface of each of the bands.

9. A method of labeling telecommunication cables comprising:

providing plurality of bands each comprising:

an inner surface and an outer surface, wherein the outer surface comprises an indicator;

a first link having a first end and a second end; and a second link having a first end and a second end, wherein each of the first end and the second end of the first link comprises one of a male connector and a female connector, and each of the first end and the second end of the second link comprises the other of the male connector and the female connector;

securing the plurality of bands to a telecommunications cable by placing the first links and the second links around the telecommunications cable, and connecting the male connectors to the female connectors, wherein the indicator and an amount of the plurality of bands secured to the telecommunications cable indicates a type of the telecommunications cable.

10. The method of claim 9, wherein the indicator is at least one of a color and a pattern.

* * * * *